US006840509B2

(12) United States Patent
Blixt

(10) Patent No.: US 6,840,509 B2
(45) Date of Patent: Jan. 11, 2005

(54) CARBURETOR FOR AN INTERNAL COMBUSTION ENGINE

(76) Inventor: Michael Blixt, Bagaretorp, Nyköping S-611 92 (SE)

( * ) Notice: Subject to any disclaimer, the term of this patent is extended or adjusted under 35 U.S.C. 154(b) by 0 days.

(21) Appl. No.: 10/653,413

(22) Filed: Sep. 3, 2003

(65) Prior Publication Data

US 2004/0070089 A1 Apr. 15, 2004

Related U.S. Application Data

(63) Continuation-in-part of application No. 10/221,670, filed as application No. PCT/SE01/00538 on Mar. 15, 2001, now Pat. No. 6,637,730.

(30) Foreign Application Priority Data

Mar. 17, 2000 (SE) ..... 0000875

(51) Int. Cl.[7] ..... F02M 7/22
(52) U.S. Cl. ..... 261/44.4; 261/51; 261/DIG. 49
(58) Field of Search ..... 261/44.2–44.8, 261/51, 50.1, 50.2, DIG. 49, DIG. 38

(56) References Cited

U.S. PATENT DOCUMENTS 1,793,148 A 2/1931 Warlay ..... 261/44.3
4,013,741 A * 3/1977 Edmonston ..... 261/44.3
4,044,080 A 8/1977 Matsumoto et al. . 261/DIG. 55
4,123,479 A 10/1978 Andreassen ..... 261/DIG. 38
4,150,070 A * 4/1979 Hashimoto et al. ..... 261/41.4
4,443,388 A * 4/1984 Teramura et al. ..... 261/39.2
4,524,034 A * 6/1985 Ellison ..... 261/44.2
4,627,401 A * 12/1986 Brandner et al. ..... 123/439
4,670,194 A * 6/1987 Buford et al. ..... 261/36.2
4,814,115 A * 3/1989 Hashimoto et al. ..... 261/44.3
5,258,143 A * 11/1993 Wang ..... 261/44.3
5,378,411 A * 1/1995 Iwaki et al. ..... 261/39.2
6,164,631 A * 12/2000 Seliminsky ..... 261/44.4
6,637,730 B2 * 10/2003 Blixt ..... 261/44.4

* cited by examiner

*Primary Examiner*—Richard L. Chiesa
(74) *Attorney, Agent, or Firm*—Nixon & Vanderhye

(57) ABSTRACT

Carburetor for an internal combustion engine showing a suction port (1) which is in connection with the combustion chamber of the motor and which is fed with liquid fuel via a nozzle (3) and a fuel channel (3.1), which leads into the suction port (1). A linearly movable valve needle (5) is arranged to extend into the fuel channel (3.1) mainly perpendicular to its longitudinal direction and to open or close this, whereby the suction port (1) is possible to throttle down or close with a throttle (4) which is movable between an open position and a closed position. The valve needle is in connection with a maneuver arm (6), which in turn is in connection with the throttle (4) and is arranged to open the nozzle (3) when the throttle (4) is opened and to close when the throttle (4) is closed.

4 Claims, 3 Drawing Sheets

CARBURETOR FOR AN INTERNAL COMBUSTION ENGINE

This application is a continuation-in-part if application Ser. No. 10/221,670, filed Sep. 16, 2002, now U.S. Pat. No. 6,637,730 issued Oct. 28, 2003, which is a 371 of PCT/SE01/00538, filed Mar. 15, 2001 the entire content of which is hereby incorporated by reference in this application.

TECHNICAL FIELD

The present invention concerns a carburetor for an internal combustion engine showing a suction port which is in connection with the combustion chamber of the motor and which is fed by liquid fuel via a nozzle and a fuel channel which leads into the suction port. A linearly movable valve needle is arranged to extend into the fuel channel mainly perpendicular to its longitudinal direction and to open or close it. The suction port is possible to throttle down or to close with a throttle which is movable between an open position and a closed position.

BACKGROUND OF THE INVENTION

Carburetors for internal combustion engines, for example motorcycles, show a suction port which is in connection with the combustion chamber of the motor and which is fed with liquid fuel via a nozzle. The suction port is possible to throttle down and to close with a throttle, which is movable between an open position, and a closed position. The throttle may be cylindrical or of a sheet form and be maneuvered with the aid of a wire which is in connection with a so-called throttle twist grip. The nozzle is usually in connection with a fuel channel which leads into the suction port and is opened and closed with the aid of a valve needle which is extending down into the opening of the fuel channel in a direction from the suction port. The valve needle may be rigidly mounted upon the throttle or be in connection with this via a wire. When the suction port is totally open, the valve needle or the wire extends across the suction port.

At motorcycles for racing the motors for cycles in the same racing class are to keep certain measures and dimensions. Also the size of the suction port is limited to a maximum diameter. It has been shown that the motor effect could be increased at a given diameter of the suction port if the placement of the valve needle or the corresponding wire across the suction port could be avoided. The American patent publications U.S. Pat. Nos. 1,793,148 and 4,123,479 described carburetors where the suction openings are not influenced by wires or valve needles but they are not suitable for use with among other things motors for motorcycles for racing.

BRIEF DESCRIPTION OF THE INVENTION

The purpose of the present invention is to achieve a carburetor for an internal combustion engine, which is better than the previously known carburetor constructions. The carburetor according to the invention shows a suction port which is in connection with the combustion chamber of the motor and which is fed with liquid fuel via a fuel channel, which leads into the suction port. A linearly movable valve needle is arranged to extend into the fuel channel and to open and close this. The suction port is possible to throttle down or to close with a throttle, which is situated on the opposite side of the suction port in relation to the fuel channel orifice, which is movable between an open position and a closed position. The valve needle is in connection with a maneuver arm which is arranged on one side of the suction port and which, in turn, is in connection with the throttle and is arranged to open the fuel channel when the throttle is opened and to close the same when the throttle is closed.

In a mode of execution of the invention, the maneuver arm is turnably arranged around an axis and in connection with the outer end of the valve needle as well as with a wedge formed part arranged upon the throttle.

In a first alternative mode of execution of the invention, the axial position of the valve needle in relation to the maneuver arm is settable with the aid of an open spring washer, a so-called "knaster," which is possible to place in an optional groove in the valve needle and which allows the maneuver arm may be fastened in different positions along the length of the valve needle.

In a second alternative mode of execution of the invention, the maneuver arm may be divided into two parts, whereby a first part abuts the throttle and the second part is in connection with the valve needle and whereby the mutual position of the parts is settable with the aid of a set screw.

In further alternative modes of execution of the invention, the maneuver arm may be formed like a wedge at that end which is in contact with the valve needle and connected with the throttle so it moves linearly at the movement of the throttle and closes the fuel channel when the throttle is closed.

It is also within the framework of the invention to design the fuel channel in the form of a pipe which extends out a bit into the suction port or to let a nozzle constitute a part of the fuel channel.

Further details and characteristics regarding the invention are evident from the description of the figures below as well as from the patent claims.

BRIEF DESCRIPTION OF THE DRAWINGS

The invention is described below in the form or an example of a mode of execution in connection with the attached figures, which show a schematically drawn carburetor.

DETAILED DESCRIPTION OF THE INVENTION

Figure 1:
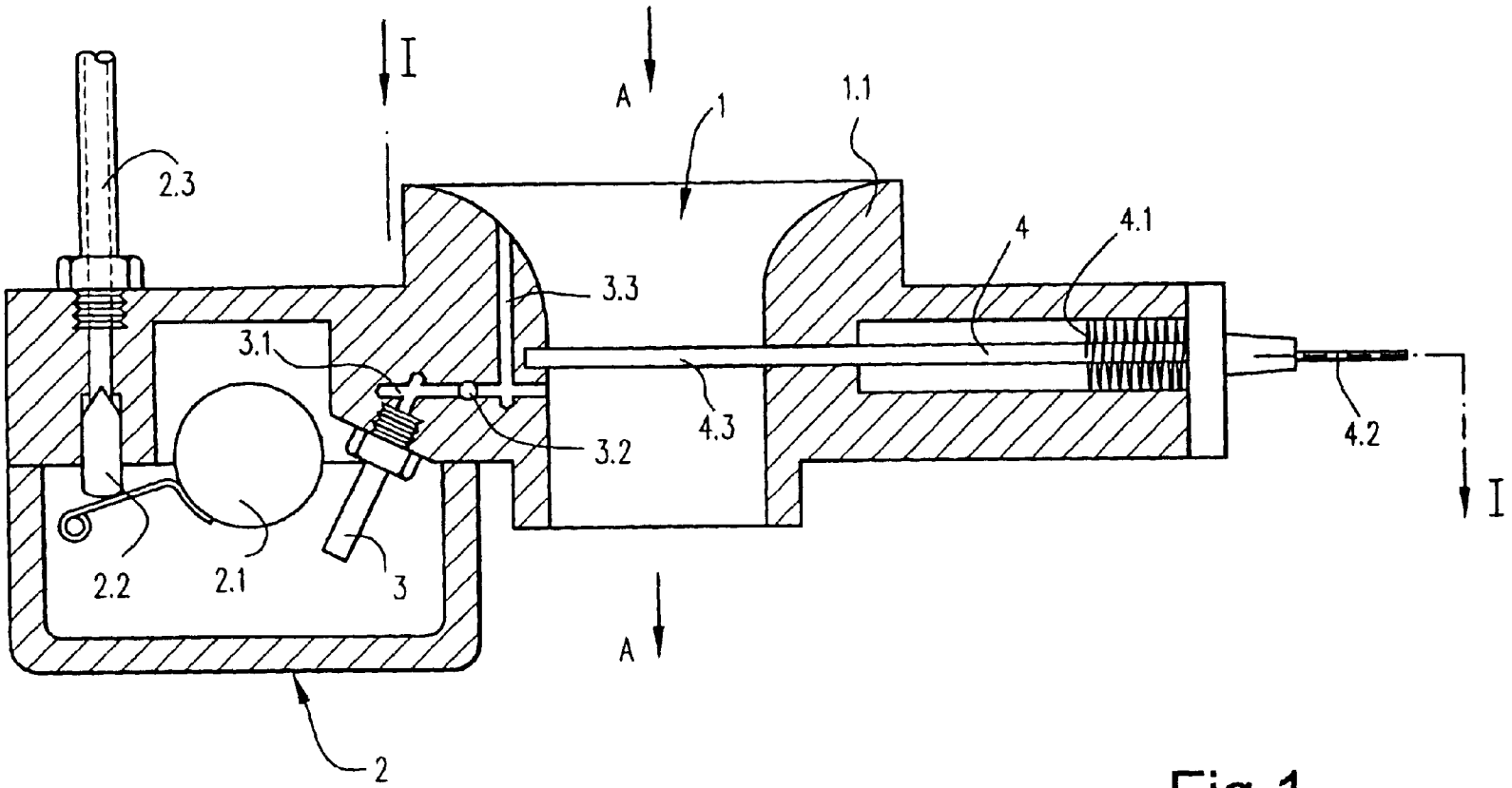
FIG. 1 shows a carburetor according to the invention in a longitudinal section through its suction port and flat chamber.
Figure 2:
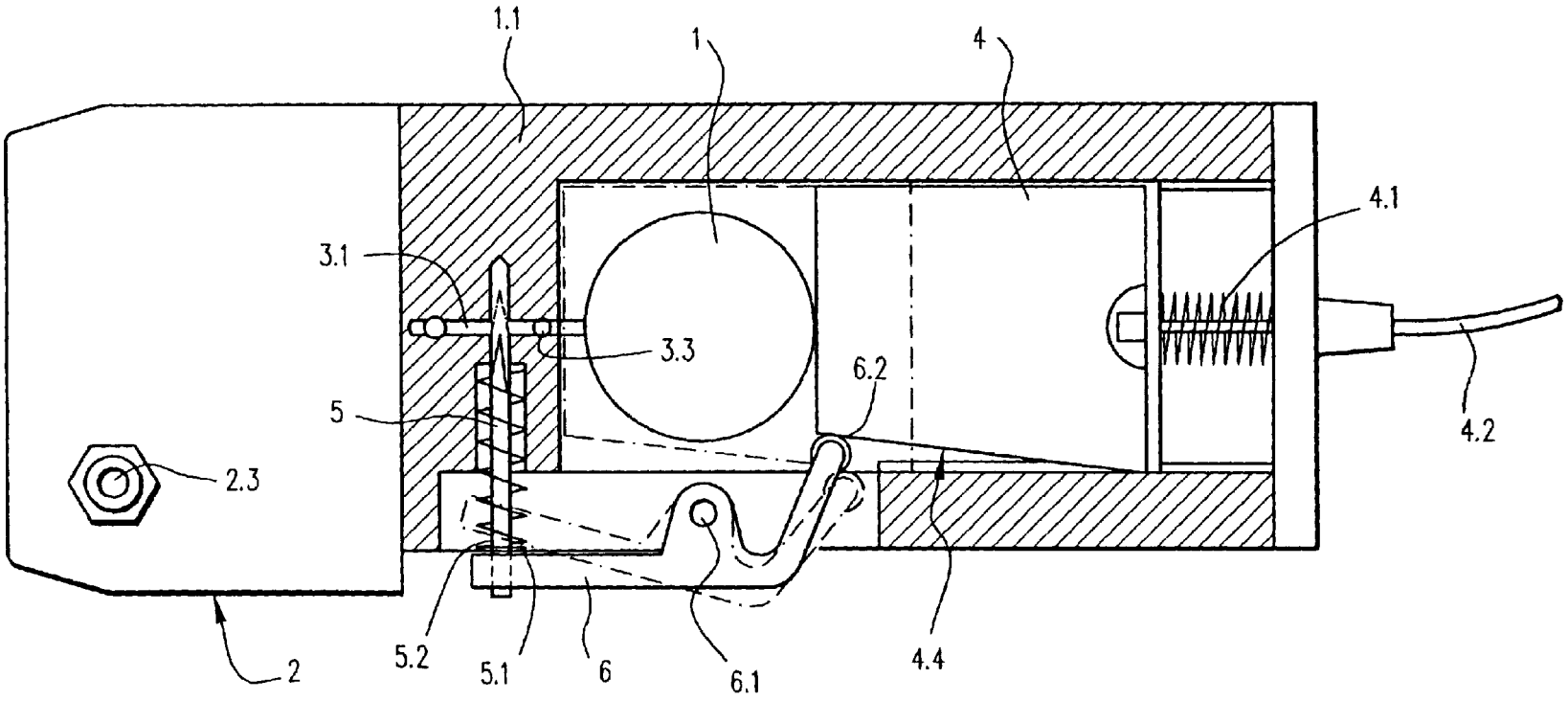
FIG. 2 shows the carburetor according to FIG. 1 partly in a horizontal section along the line I—I in FIG. 1.

The carburetor which is shown in the Figure shows a suction port 1 for air arranged in a carburetor body 1.1, which is fed with liquid fuel from a float chamber 2 via a nozzle 3. In the float chamber 2, a float 2.1 is arranged to open and to close a fuel valve 2.2, which is in connection with a fuel pipe 2.3 for delivery of fuel to the float chamber 2. A sheet formed throttle 4 is with the aid of a spring 4.1 arranged to be moved from its opened position, which is shown with full lines in FIG. 2, to its closed position which is shown with dash dotted lines in FIG. 2. The throttle 4 is held in an open position with the aid of a wire 4.2, which is in connection with a throttle twist grip. The throttle 4 moves into parallel grooves 4.3 in the carburetor house, which grooves are arranged an both sides of the throttle 4.

The nozzle 3 is in connection with a fuel channel 3.1 leading to and into the suction port 1 which may be opened or closed with the aid of a valve needle 5 which is arranged to extend perpendicular into a hole 3.2 in the fuel channel 3.1 and to monitor the feeding of fuel to the suction port 1. An air channel 3.3 for emulsifying air extends from a ring formed hopper 1.1 which is surrounding the suction port 1 and into the fuel channel 3.1. The valve needle 5 is influenced by a maneuver arm 6, which is in connection with the outer end of the valve needle 5 and also in connection with an edge 4.4, which is wedge-like sloping upon the throttle 4. The maneuver arm 6 extends totally on one side of the suction port 1 and does not intrude on this but allows an undisturbed flow through of air.

The position of the valve needle 5 in the longitudinal direction is settable with the aid of an open spring washer 5.1, a so-called. "knaster," which is placed in some of the ring formed recesses 5.2 that are arranged in the outer end of the valve needle 5. A helical spring 5.3 holds the valve needle 5 pressed outwards from the fuel channel 1 when the throttle 4 is in different degrees of opening. The maneuver arm 6 shows a roll 6.2 in its end which abuts the sloping edge 4.4 upon the throttle 4 and is turned around the axis 6.1 when the throttle 4 is moved from its open position to its closed position, which is shown with dash dotted lines in FIG. 2 and vice versa. When the maneuver arm 6 is turned, the valve needle 5 is moved so that it holds the fuel channel 31. closed when the throttle 4 is in its closed position and open when the throttle 4 is in an open position.

Figure 3:
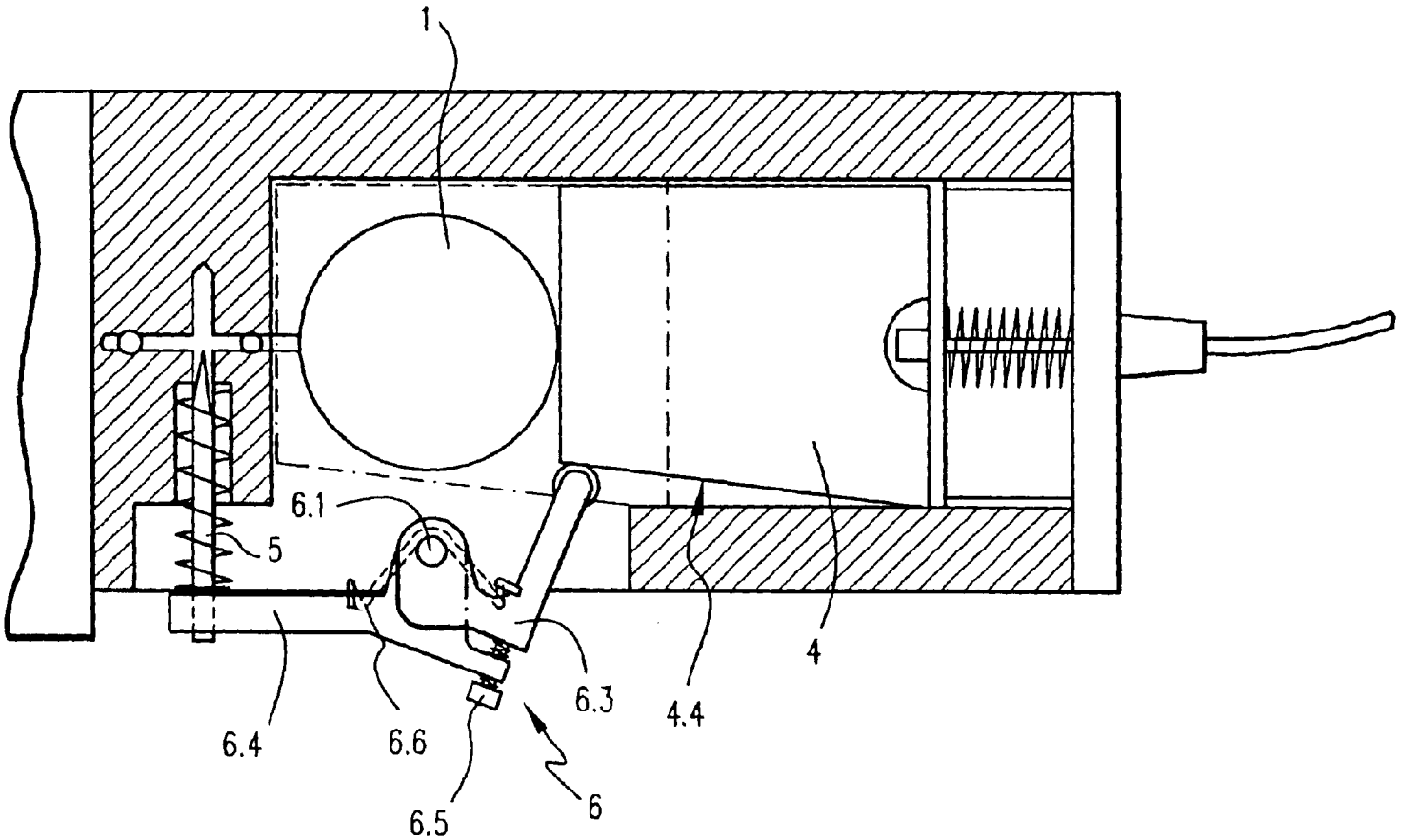
FIG. 3 shows enlarged a part of an alternative mode of execution of the carburetor according to the invention.

In FIG. 3, an alternative mode of execution of the carburetor according to the invention is shown where the maneuver arm 6 is divided into two parts, whereby the first part 6.3 abuts the wedge formed edge 4.4. upon the throttle 4 and the second part 6.4 is in connection with the valve needle 5. The two maneuver arm parts 6.3, 6.4 each one is turnable around the axis 6.1 and settable with the aid of a set screw 6.5. The first part 6.3 is held pressed against the set screw 6.5 upon the other part 6.4 with the aid of a spring 6.6. By turning the set screw 6.5, the position of the valve needle 5 in relation to the position of the throttle 4 may be set. This solution replaces the adjustment with a spring washer which is described above.

The edge 4.4 of the throttle 4 may also be given other forms than a wedge form depending on if the movement of the valve needle 5 may be other than linearly dependent upon the movement of the throttle 4.

The edge 4.4 of the throttle 4 may also be given other forms than a wedge form depending on if the movement of the valve needle 5 may be other than linearly dependent upon the movement of the throttle 4.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. Carburetor for an internal combustion engine showing a suction port (1) arranged in a carburetor body (1.1) which is in connection with the combustion chamber of the motor and which is fed with a liquid fuel via a fuel channel (3.1) which is arranged in the carburetor body (1.1) and which leads to the suction port (1), the suction port (1) being possible to throttle down or close down with a throttle (4) which is movable between an open position and a closed position, characterized in that a linearly movable valve needle (5) is arranged in the carburetor body (1.1) with its inner end being aimed for projecting into the fuel channel (3.1) and to open and close the fuel channel (3.1), that the outer end of the valve needle (5) is in connection with a maneuver arm (6) which is arranged on the side of the suction port (1) and which is turnably arranged around an axis (6.1), that the maneuver arm (6) is in connection with a wedge formed portion (4.4) arranged on one side of the throttle (4), the maneuver arm (6) being arranged to turn and open the fuel channel (3.1) when the throttle (4) is opened and to close the fuel channel (3.1).

2. Carburetor according to claim 1, characterized in that a first outer end of the maneuver arm (6) is in connection with the valve needle (5) and a second outer end of the maneuver arm (6) is in connection with the wedge formed portion (4.4) of the throttle (4).

3. Carburetor according to claim 1, characterized in that the axial position of the valve needle (5) in relation to the maneuver arm (6) is settable with the aid of an open spring washer (5.2) which is placeable in an optional recess in the valve needle.

4. Carburetor according to claim 1, characterized in that the maneuver arm (6) is divided into two parts, a first part (6.3) abutting the throttle (4) and a second part (6.4) being in connection with the valve needle (5) and that the mutual position of the parts (6.3, 6.4) is settable with the aid of a setting screw (6.5).

* * * * *